US007802965B2

(12) United States Patent
Huang et al.

(10) Patent No.: US 7,802,965 B2
(45) Date of Patent: Sep. 28, 2010

(54) COOLING FAN

(75) Inventors: Wen-Shi Huang, Taoyuan Hsien (TW); Kuo-Cheng Lin, Kuei San (TW); Li-Kuang Tan, Kuei San (TW); Tsung-Yu Lei, Kuei San (TW); Wen-Ha Liu, Taoyuan Hsien (TW)

(73) Assignee: Delta Electronics Inc., Taoyuan Hsien (TW)

( * ) Notice: Subject to any disclaimer, the term of this patent is extended or adjusted under 35 U.S.C. 154(b) by 0 days.

(21) Appl. No.: 11/332,397

(22) Filed: Jan. 17, 2006

(65) Prior Publication Data

US 2006/0115359 A1 Jun. 1, 2006

Related U.S. Application Data

(63) Continuation of application No. 10/339,472, filed on Jan. 9, 2003.

(30) Foreign Application Priority Data

Apr. 30, 2002 (TW) ..... 91205935 U

(51) Int. Cl.
*F04D 29/52* (2006.01)

(52) U.S. Cl. ..... 415/165; 415/220

(58) Field of Classification Search ..... 415/201, 415/220, 221, 222, 223, 182.1, 183, 185, 415/186, 208.1, 208.2, 208.5, 211.1, 148, 415/151, 159, 165

See application file for complete search history.

(56) References Cited

U.S. PATENT DOCUMENTS 4,353,680 A 10/1982 Hiraoka et al.
4,724,747 A 2/1988 Sturm et al.
5,288,203 A * 2/1994 Thomas ..... 165/80.3
5,407,324 A * 4/1995 Starnes et al. ..... 415/208.5
5,707,205 A 1/1998 Otsuka
5,979,541 A * 11/1999 Saito ..... 165/80.3
6,132,171 A 10/2000 Fujinaka et al.
6,179,562 B1 * 1/2001 Fujinaka ..... 415/208.5
6,183,196 B1 * 2/2001 Fujinaka ..... 415/208.5
6,270,313 B1 8/2001 Chuang et al.

(Continued)

FOREIGN PATENT DOCUMENTS

TW 395527 6/2000

OTHER PUBLICATIONS

Merriam-Webster's collegiate dictionary, 10th edition, 1998, p. 607.

*Primary Examiner*—Richard Edgar
(74) *Attorney, Agent, or Firm*—Muncy, Geissler, Olds & Lowe, PLLC

(57) ABSTRACT

A cooling fan with high heat-dissipating performance includes a plurality of blades; and a frame for receiving the blades therein, wherein the frame has a reduced height for exposing the blades to outside of the frame so as to allow air to enter into the frame via a top portion and a peripheral portion of the blades to improve air introduction and heat dissipating efficiency of the cooling fan. A cover may be mounted to a top surface of the frame, and formed with a plurality of openings for allowing air to enter into the frame through the openings; such an arrangement cam effectively enhance air intake and working efficiency of the cooling fan.

19 Claims, 8 Drawing Sheets

U.S. PATENT DOCUMENTS

| | | | |
|---|---|---|---|
| 6,386,843 | B1 | 5/2002 | Umeda et al. |
| 6,406,258 | B1 | 6/2002 | Lin et al. |
| 6,481,963 | B1 | 11/2002 | Lin et al. |
| 6,572,333 | B2 | 6/2003 | Fujinaka |
| 2002/0076323 | A1 | 6/2002 | Fujinaka |
| 2003/0202878 | A1 | 10/2003 | Huang et al. |
| 2003/0202879 | A1 | 10/2003 | Huang et al. |
| 2003/0219339 | A1 | 11/2003 | Huang et al. |

* cited by examiner

COOLING FAN

CROSS-REFERENCE TO RELATED APPLICATION

This application is a Continuation of co-pending application Ser. No. 10/339,472, filed on Jan. 9, 2003, and for which priority is claimed under 35 U.S.C. §120; and this application claims priority of Application No. 091205935, filed in Taiwan, R.O.C. on Apr. 30, 2002 under 35 U.S.C. §119; the entire contents of all are hereby incorporated by reference.

FIELD OF THE INVENTION

The present invention relates to cooling fans, and more particularly, to a cooling fan for dissipating heat produced by internal elements of a computer, wherein a frame of the cooling fan for receiving blades is formed with a reduced height to increase air introduction area and thus to enhance working efficiency of the cooling fan.

BACKGROUND OF THE INVENTION

As electronic and information industries prosperously develop, various kinds of electronic products with different appearances and functions are introduced into the market. For example, a central processing unit (CPU) of computer may be formed with chips operating at a high speed up to 1-2 GHz, and such high-speed operation would lead to accumulation of heat produced from electric currents by effect of resistance in the CPU. Therefore, the computer is mostly mounted with a heat-dissipating device, so as to confine operation of the CPU within a certain range of temperature and to prevent the chips from being damaged by over-heat that may cause failure of the entire computer.

FIGS. 1A and 1B illustrate a conventional cooling fan 100 for dissipating heat produced by chips of a CPU. This cooling fan 100 includes a frame 101 adapted to be screwed to heat sinks (not shown), and a plurality of blades 103 disposed in and enclosed by the frame 101 and connected to a power output shaft of a motor 102. The motor 102 drives the blades 103 to rotate and thereby suck or exhaust air into or out of the frame 101 to create airflow effect. When air is directed toward the heat sinks, it takes heat away from the heat sinks and thus cools the chips of the CPU. The cooling fan 100 is formed with an air inlet for introducing air into the frame 101, as shown in FIG. 1B, the air inlet is a top opening of the cooling fan 100 for exposing the blades 103. As such, if a block is situated closely in front of the air inlet, it would impede movement of air and adversely affect airflow effect for the blades 103.

Moreover, in response to profile miniaturization of electronic products, a computer is provided with limited internal space for receiving a reduced-sized cooling fan connected to heat sinks. As a result, the cooling fan may be located very close to a housing of the computer, which reduces air introduction area and space/distance for generating airflow effect, and thereby leads to poor heat dissipation for the computer.

Therefore, the problem to be solved herein is to provide a cooling fan with enhanced cooling effect for use in a limited-sized computer.

SUMMARY OF THE INVENTION

A primary objective of the present invention is to provide a cooling fan for use in a decreasingly sized computer, wherein the cooling fan is adapted to have increased air introduction area to enhance cooling performance thereof.

Another objective of the invention is to provide a cooling fan, wherein a frame of the cooling fan is formed with a reduced height so as to increase air introduction area and airflow effect for the cooling fan.

A further objective of the invention is to provide a cooling fan, for allowing air to be smoothly introduced into operative part of a computer, so as to conduct good heat dissipation and help prolong lifetime of the computer.

To achieve the above and other objectives, the present invention proposes a cooling fan including a plurality of blades; and a frame for receiving the blades therein, wherein the frame has a reduced height for exposing the blades to outside of the frame so as to allow air to enter into the frame via a top portion and a peripheral portion of the blades to thereby improve air introduction and heat dissipating efficiency of the cooling fan.

The above cooling fan may further include a cover mounted on a top surface of the frame. The cover serves as a protective shield to prevent an operator from being in contact with or injured by the blades during maintaining or repairing a computer. The cover may be formed with a plurality of openings for allowing air to enter into the frame through the openings, and thereby helps enhance air intake and working efficiency of the cooling fan.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE PREFERRED EMBODIMENTS

The following description is made with reference to FIGS. 2-7 for depicting preferred embodiments of a cooling fan provided in the present invention.

Figure 1A:
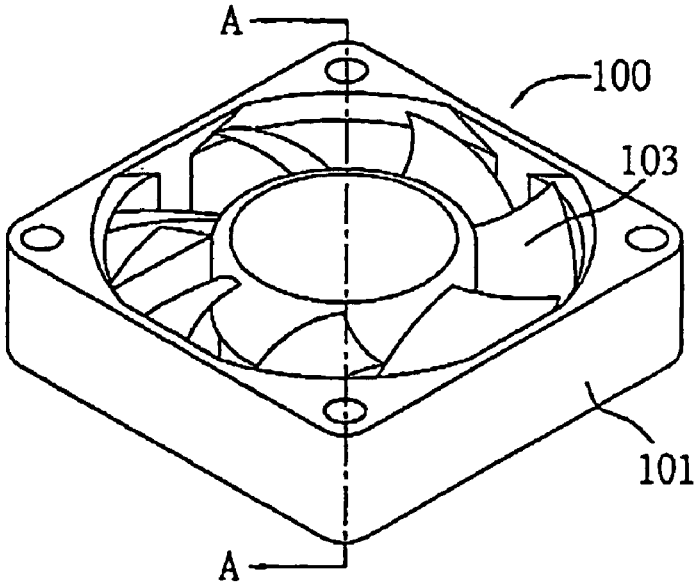
FIG. 1A (PRIOR ART)
FIG. 1A (PRIOR ART) is a perspective view of a conventional cooling fan.
Figure 1B:
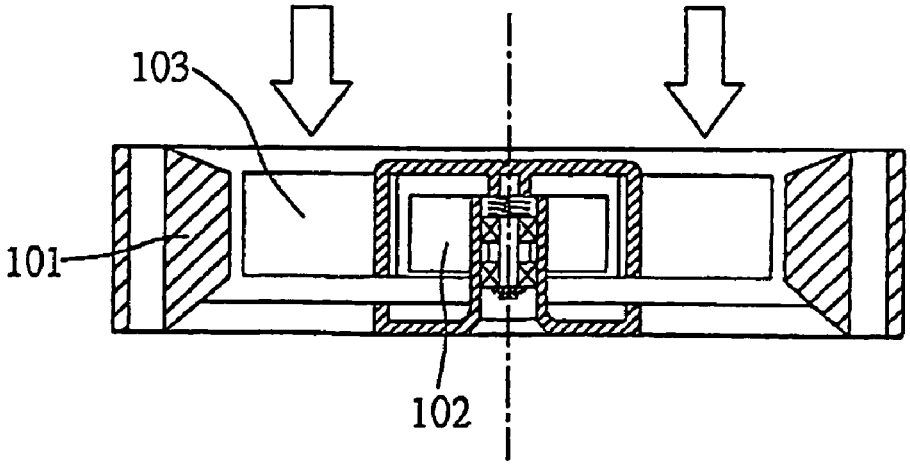
FIG. 1B (PRIOR ART)
FIG. 1B (PRIOR ART) is a cross-sectional view of the cooling fan shown in FIG. 1A taken along line A-A.
Figure 2A:
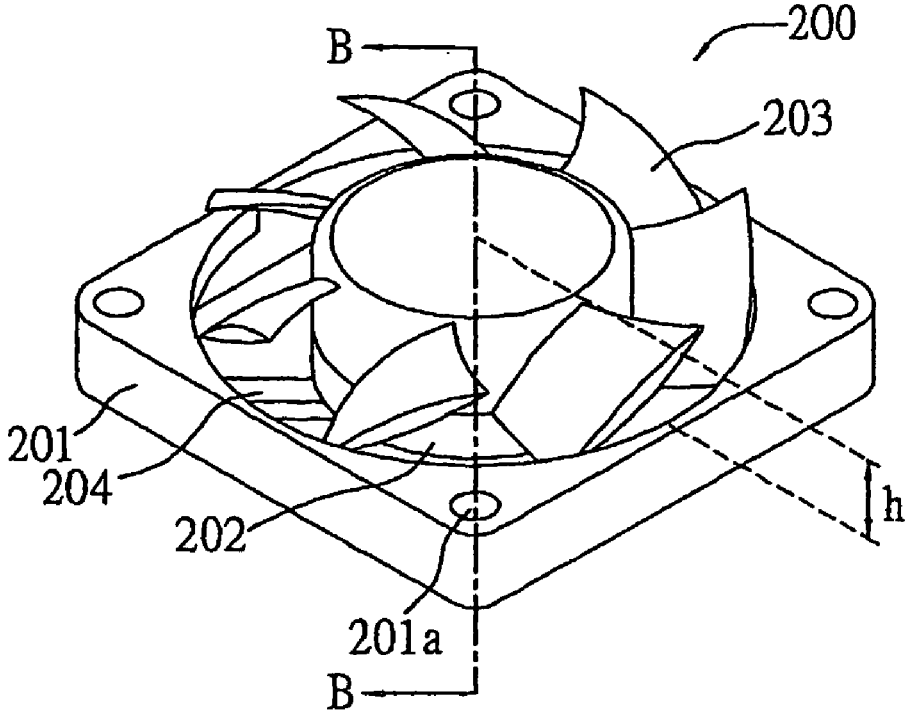
FIG. 2A is a perspective view of a cooling fan according to a first embodiment of the invention.
Figure 2B:
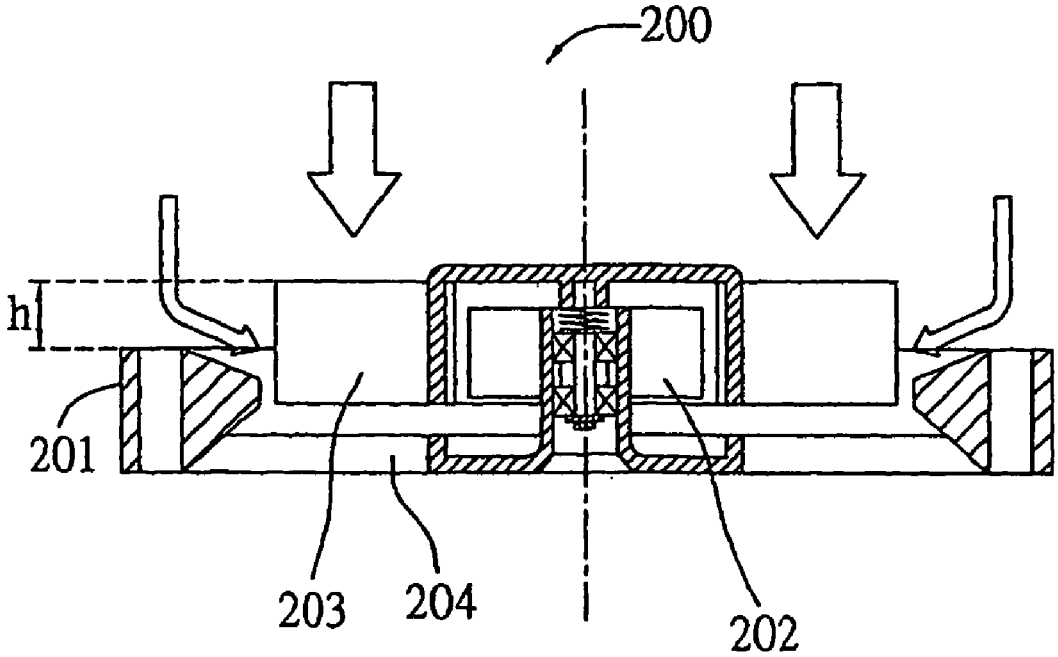
FIG. 2B is a sectional view of the cooling fan shown in FIG. 2A taken along line B-B.

FIGS. 2A and 2B illustrate a cooling fan 200 according to a first embodiment of the invention. As shown in the drawings, the cooling fan 200 includes a plurality of blades 203 connected to and driven by a driving means such as a motor 202 to rotate and thereby suck in or exhaust air to create airflow effect; and a frame 201 formed with a reduced height to increase air introduction area and receiving the blades 203, wherein a plurality of through holes 201*a* are peripherally formed on the frame 201 and can be engaged with mounting screws (not shown) for connecting the cooling fan 200 to a heat sink (not shown) conventionally used in a computer.

The frame 201 is reduced in height by a distance h from the top of the cooling fan 200 in a manner as to increase contact area between the blades 203 received within the frame 201 (especially the outer periphery of the blades 203) and ambient air. As the blades 203 are driven by the motor 202 to suck air into the cooling fan 200, as shown in FIG. 2B, airflow produced by rotation of the blades 203 moves in a direction indicated by arrows in the drawing, including the part of the airflow entering into the cooling fan 200 through a main or central air inlet of the frame 201, and the part of the airflow flowing through the outer periphery of the blades 203, thereby increasing air introduction area of the cooling fan 200 and allowing a rate of air intake by rotation of the blades 203 to be enhanced to improve airflow effect.

The distance h for height reduction of the frame 201 of the cooling fan 200, with respect to the top of the blades 203, depends on the extent of improvement in airflow effect to be achieved. It should be noted that a minimum height of the frame 201 is not smaller than a thickness of connecting ribs 204 provided at the bottom of the cooling fan 200, as shown in FIG. 2B. In other words, the frame 201 with the minimum height is dimensioned equally to the height of the connecting ribs 204 and integrally formed with the connecting ribs 204.

Figure 3:
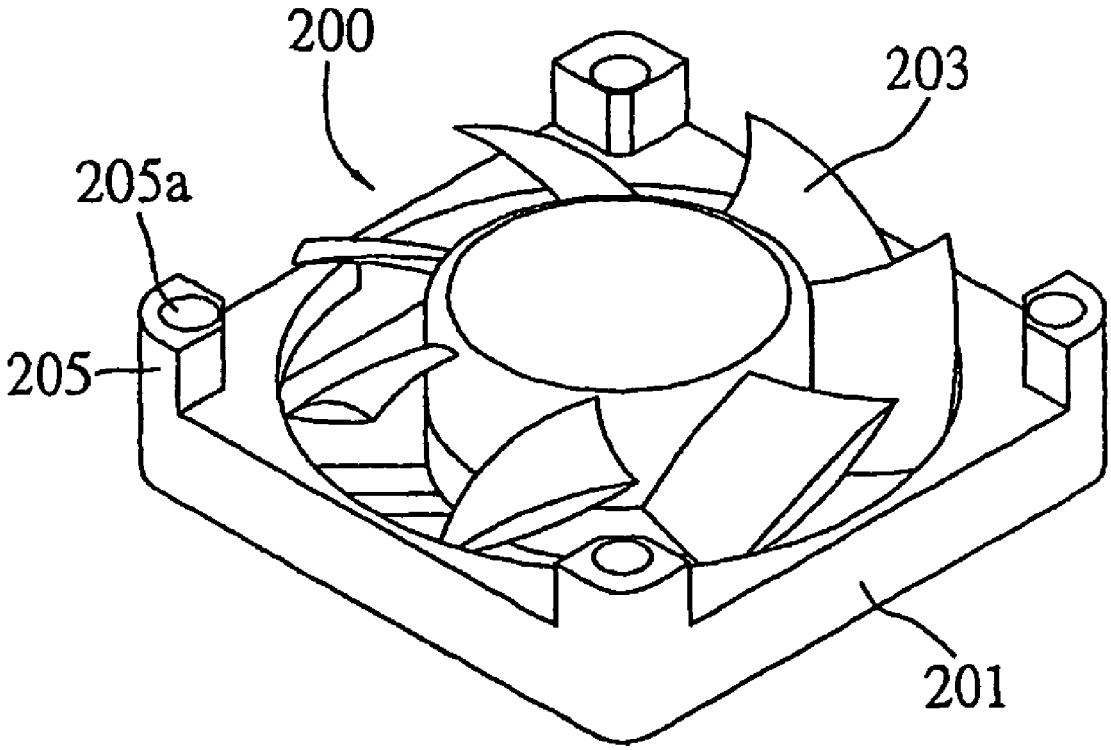
FIG. 3 is a perspective view of the cooling fan according to a second embodiment of the invention.

FIG. 3 illustrates the cooling fan 200 according to a second embodiment of the invention. As shown in the drawing, this cooling fan 200 differs from that of the first embodiment (FIG. 2A) in that the frame 201 of this cooling fan 200 is provided with a plurality of air-guiding parts 205 directly formed at peripheral positions e.g. four corner areas of the frame 201. Each of the air-guiding parts 205 is provided with a through hole 205*a*, so as to allow mounting screws (not shown) for connecting the cooling fan 200 to a heat sink (not shown). Each of the air-guiding parts 205 has its outer peripheral surface being optimally curve-shaped in compliance with a moving direction of airflow, such that through the rotation of the blades 203 received within the frame 201, air can be quickly and smoothly sucked into the frame 201 along the curve-shaped outer peripheral surfaces of the air-guiding parts 205 to thereby generate desirable airflow effect and reduce the noise of vibration during the operation process.

Figure 4:
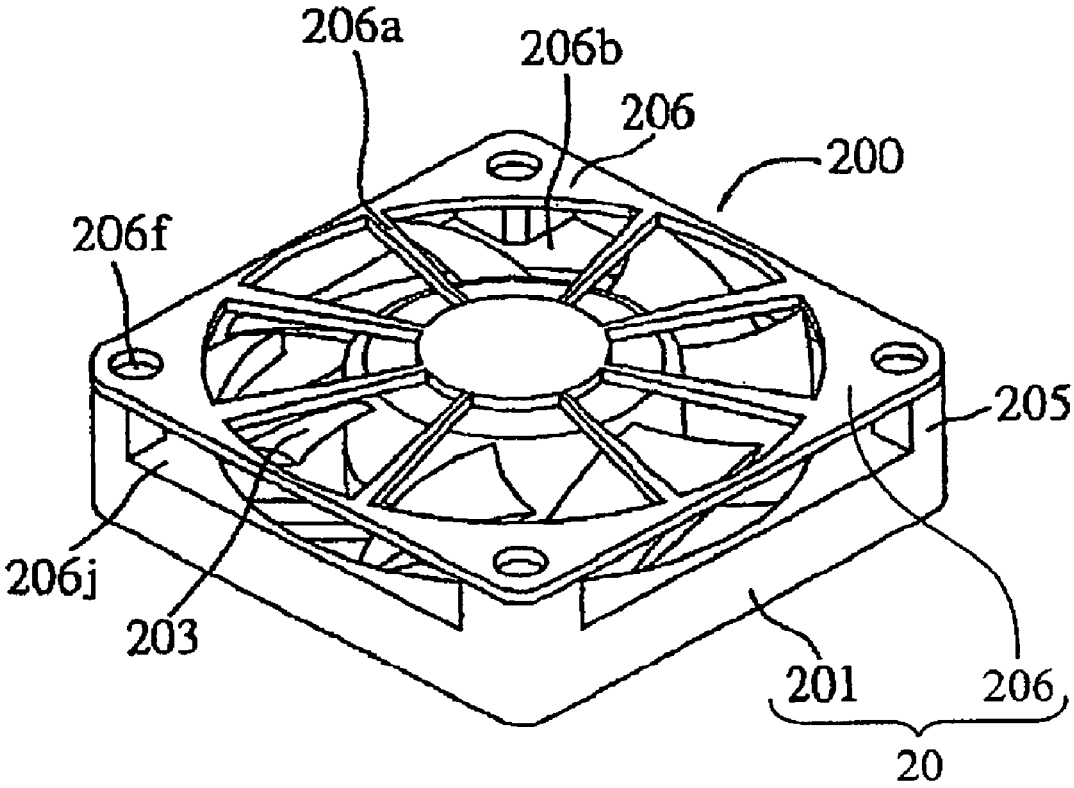
FIG. 4 is a perspective view of the cooling fan according to a third embodiment of the invention.

FIG. 4 illustrates the cooling fan 200 according to a third embodiment of the invention. As shown in the drawing, this cooling fan 200 differs from that of the second embodiment (FIG. 3) in that, a cover 206 is mounted on the top of the frame 201 to form a housing 20 of this cooling fan 200. The cover 206 is substantially shaped as a flat plate, and formed with a plurality of bars 206*a* and openings 206*b* in a manner that adjacent openings 206*b* are spaced by one of the bars 206*a*, wherein top surfaces of the bars 206*a* may be level with the cover 206 or biased by a suitable angle with respect to the cover 206. The cover 206 is formed with a plurality of holes 206*f* positioned corresponding to the air-guiding parts 205 on the frame 201, such that mounting screws (not shown) can extend through the holes 206*f* for connecting the cover 206 to the frame 201. Provision of the cover 206 to the frame 201 can enhance structural strength of the cooling fan 200, and the cover 206 may serve as a safety shield covering the blades 203 to prevent an operator from being in contact with and injured by the blades 203 during repairing or maintaining a computer.

When the above cooling fan 200 is in use, air sucked by the rotating blades 203 can enter into the frame 201 via the openings 206*b* of the cover 206 and side openings 206*j* formed between the cover 206 and the frame 201, thereby increasing air introduction area of the cooling fan 200 and improving airflow effect.

Figure 5A:
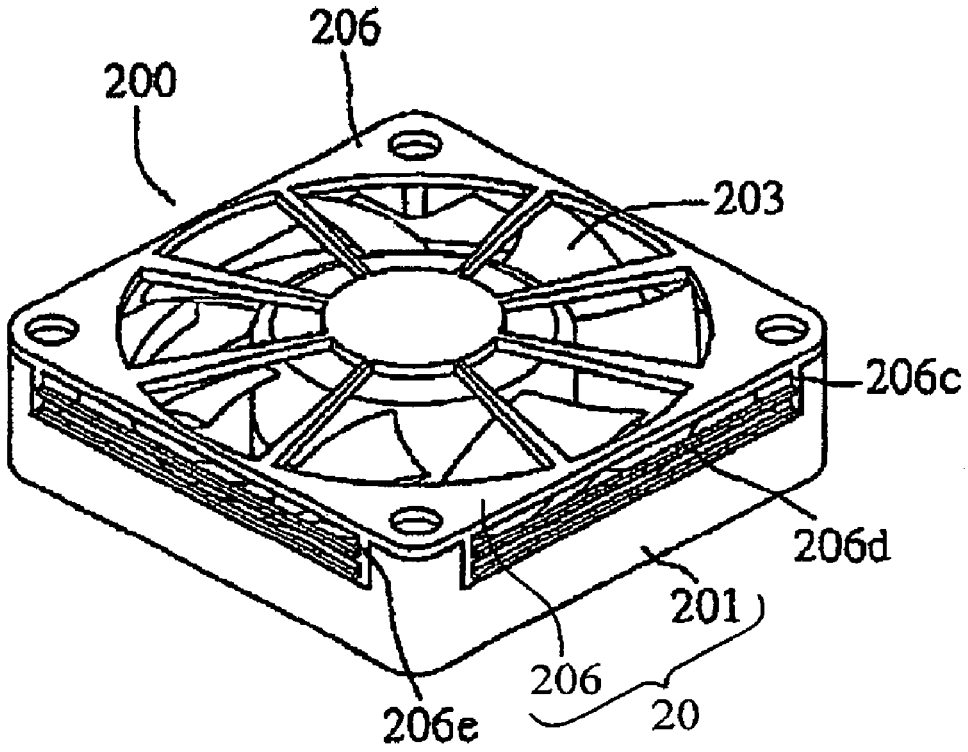
FIGS. 5A and 5B are respectively perspective views of the cooling fan according to a fourth embodiment of the invention.
Figure 5B:
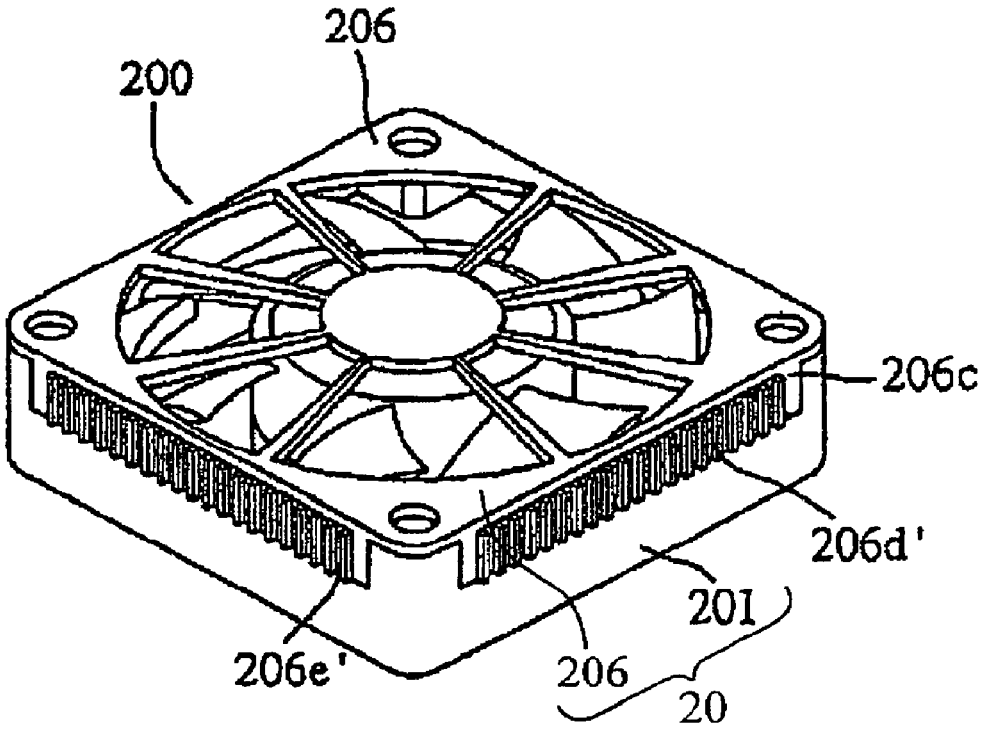

FIG. 5A illustrates the cooling fan 200 according to a fourth embodiment of the invention. As shown in the drawing, this cooling fan 200 differs from that of the third embodiment (FIG. 4) in that the cover 206 mounted on the frame 201 to form a housing 20 is further provided with a plurality of side plates 206*c* that extend from peripheral edges of the cover 206 and are vertically bent downwards. Each of the side plates 206*c* is formed with a plurality of lateral bars 206*d* and lateral openings 206*e* in a manner that adjacent lateral openings 206*e* are spaced by one of the lateral bars 206*d*, wherein the lateral bars 206*d* can be arranged horizontally or biased by a suitable angle with respect to the side plates 206*c*; such an arrangement can direct air smoothly into the frame 201 of the cooling fan 200. Alternatively, as shown in FIG. 5B, the side plates 206*c* of the cover 206 may be formed with a plurality of vertical bars 206*d*' and vertical openings 206*e*' in a manner that adjacent vertical openings 206*e*' are spaced by one of the vertical bars 206*d*', wherein the vertical bars 206*d*' can be biased by a suitable angle with respect to the side plates 206*c*; such an arrangement can prevent deposition of dust from the upper, thereby reducing dust sucked into the cooling fan 200.

Figure 6:
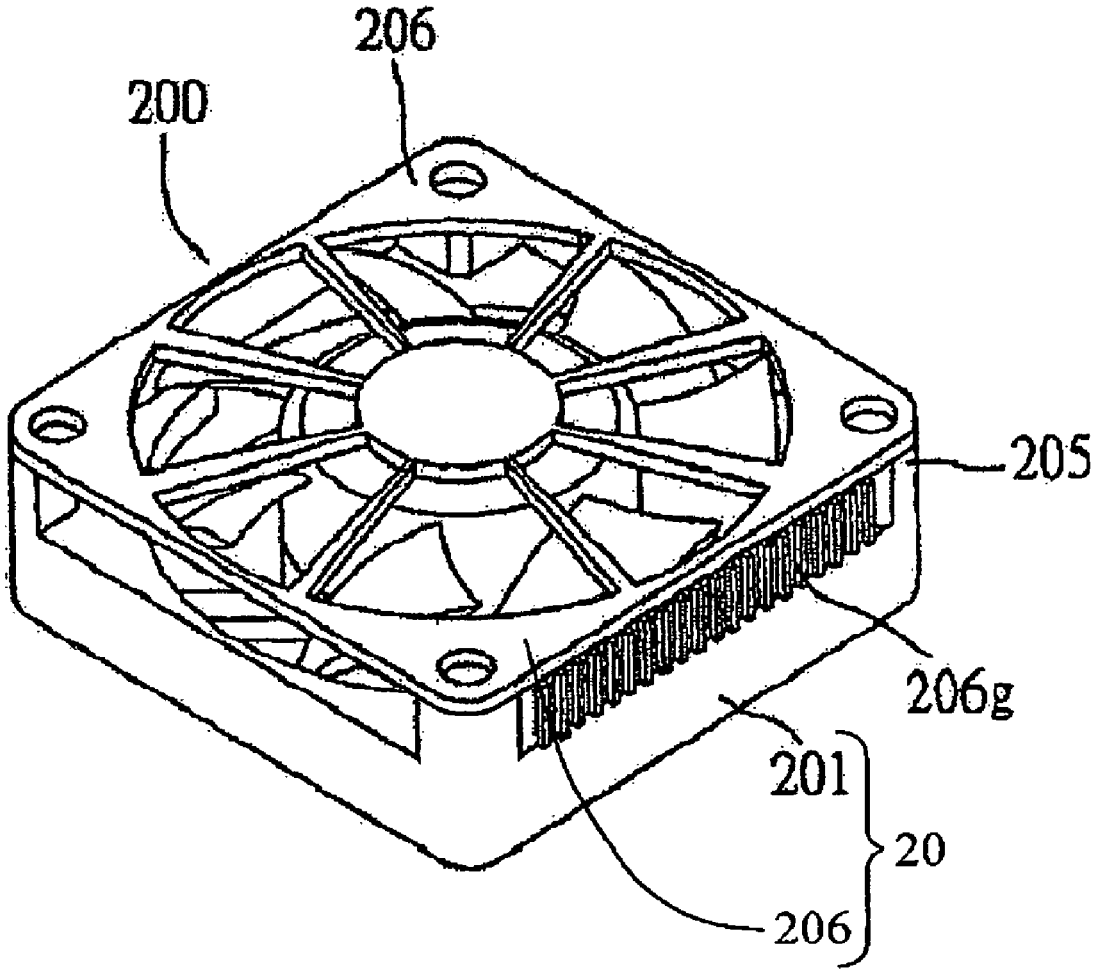
FIG. 6 is a perspective view of the cooling fan according to a fifth embodiment of the invention.

FIG. 6 illustrates the cooling fan 200 according to a fifth embodiment of the invention. As shown in the drawing, this cooling fan 200 differs from that of the third embodiment (FIG. 4) in that this cover 206 further includes at least one grid portion 206*g* vertically protruding from peripheral edges of the flat top portion of the cover 206 downwards, allowing the grid portion 206*g* to abut against the frame 201. The grid portion 206*g* is formed with a plurality of vertical bars and vertical openings for allowing air to flow through the vertical openings, wherein the vertical bars can be biased by a suitable angle for providing preferable airflow effect to direct air into the frame 201. The air-guiding parts 205 are directly formed on corner areas of the frame 201 for smoothly introducing air into the frame 201.

Figure 7:
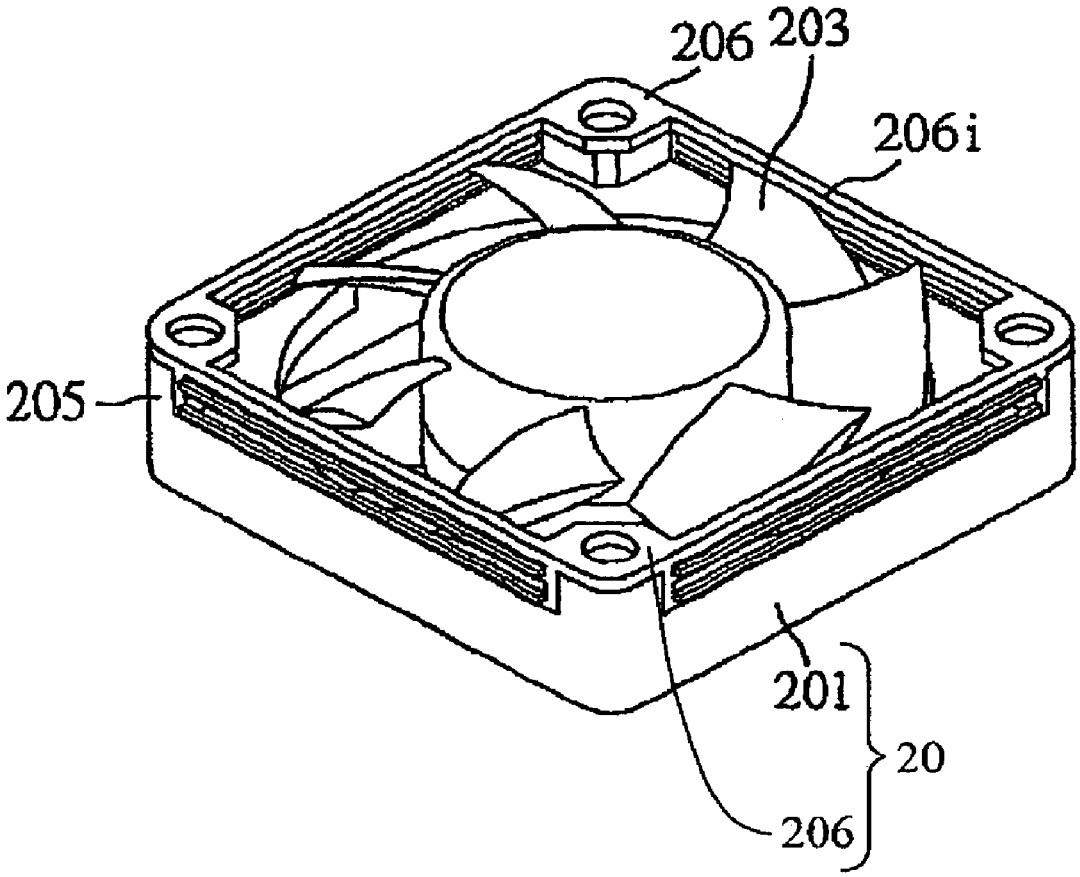
FIG. 7 is a perspective view of the cooling fan according to a sixth embodiment of the invention.

FIG. 7 illustrates the cooling fan 200 according to a sixth embodiment of the invention. As shown in the drawing, this cooling fan 200 differs from that of the fourth embodiment (FIG. 5A) in that the cover 206 is mounted on the frame 201 to form a housing 20 and of a frame shape encompassed by a plurality of ribs 206*i* for exposing the blades 203 received within the frame 201 to increase air introduction area. Certainly, the ribs 206*i* can be arranged vertically or horizontally.

Figure 8:
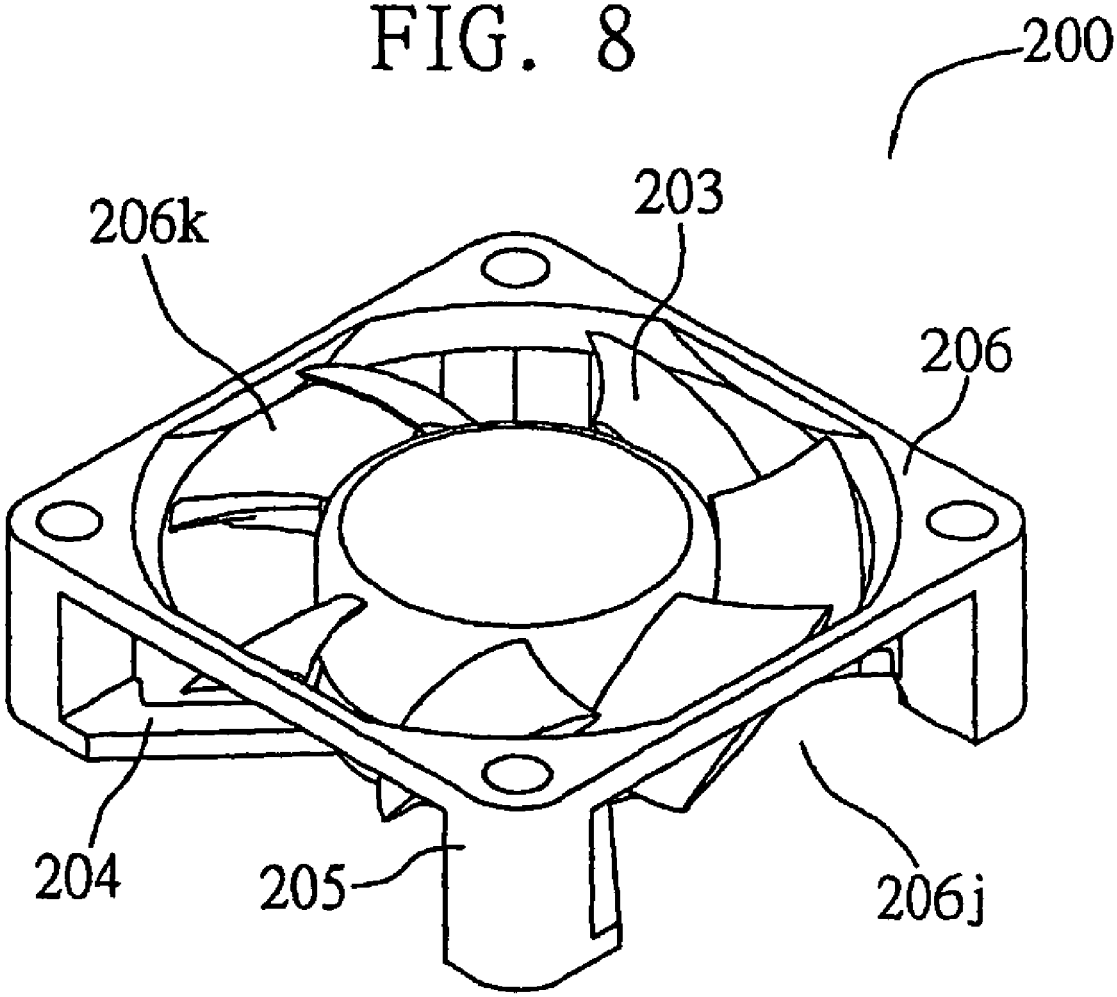
FIG. 8 is a perspective view of the cooling fan according to a seventh embodiment of the invention.

FIG. 8 illustrates the cooling fan 200 according to a seventh embodiment of the invention. As shown in the drawing, this cooling fan 200 differs from that of the third embodiment (FIG. 4) in that the cover 206 mounted on the top of the frame of this cooling fan 200 is not formed with a plurality of bars (designated by the reference numeral 206*a* in FIG. 4), but has a hollow portion 206*k* for receiving the blades 203 therein. Moreover, side openings 206*j* (between the cover 206 and the frame 201, as shown in FIG. 4) extend downwardly to the bottom of the frame by removing a portion of the frame 201 adjacent to the side openings 206*j*, making more exposure of the blades 203 to ambient air. In other words, the height of the frame is reduced to the minimum equal to the height of the connecting ribs 204 provided at the bottom of the cooling fan 200, allowing the cover 206 to be primarily supported by the peripherally-situated air-guiding parts 205 of the frame. This arrangement significantly increases air introduction area of the cooling fan 200, thereby facilitating more air intake into the frame and improving airflow effect.

The cooling fan 200 of the above embodiments can be fabricated by screwing the frame 201 and the cover 206 together; alternatively, the frame 201 and the cover 206 may be integrally formed through injection molding to form a housing 20.

Therefore, the cooling fan according to the invention can effectively increase air introduction area thereof, and also helps reduce thermal resistance and noise generated during operation of the cooling fan. It should be understood that this cooling fan is not limited for use with computers, but can be widely adopted in other electronic products with heat dissipating structure.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A cooling fan comprising:

a plurality of blades;

a frame for receiving the blades therein, wherein a height of the frame is reduced to an extent for exposing the blades, and the frame includes a plurality of air-guiding parts directly extended from corner areas of the frame; and a cover assembled with the frame through the air-guiding parts, and having a top portion and at least one side plate, wherein the side plate is extended from a peripheral edge of the top portion and vertically bent downwards, the side plate is formed with a plurality of vertical or lateral bars biased with an angle with respect to the side plate such that at least one air intake is formed between the bars therethrough and the side plate abuts against the air guiding part of the frame.

2. The cooling fan of claim 1, wherein the frame further includes a plurality of ribs formed on a bottom portion of the frame for supporting the blades and strengthening the cooling fan.

3. The cooling fan of claim 1, wherein top portion has an opening for allowing air flowing therethrough.

4. The cooling fan of claim 1, wherein the bars of the side plate form a grid structure.

5. A cooling fan comprising:

a plurality of blades;

a frame for receiving the blades therein, wherein the frame comprises at least one air-guiding part directly formed with a periphery of the frame and directly extending from corner areas of the frame, and a height of the frame is reduced to an extent for exposing the blades so as to allow air to enter into the frame via a top portion and a peripheral portion of the blades to improve air introduction and heat dissipation efficiency of the cooling fan; and a cover mounted to the air-guiding part of the frame, wherein the cover is provided with a top portion and a plurality of side plates, the side plates are extended from peripheral edges of the top portion and vertically bent downwards, the side plates abut against the air guiding part of the frame each of the side plates is formed with a plurality of bars and openings in a manner that adjacent openings are spaced by one of the bars, and the cover and the frame are formed as a single piece.

6. The cooling fan of claim 5, wherein the top portion being formed with a plurality of bars and openings in a manner that adjacent openings are spaced by one of the bars.

7. The cooling fan of claim 6, wherein top surfaces of the bars of the top portion are biased by a predetermined angle, with respect to the top portion of the cover, and non-perpendicular to the top portion.

8. The cooling fan of claim 5, wherein the bars of the side plates are vertical bars, and the vertical bars are biased by a predetermined angle with respect to the side plates, and non-perpendicular to the side plates.

9. The cooling fan of claim 5, wherein the bars of the side plate are lateral bars, and the lateral bars are horizontally biased by a predetermined angle with respect to the side plates, and non-perpendicular to the side plates.

10. The cooling fan of claim 5, wherein the top portion is formed with a frame shape.

11. A cooling fan comprising:

a plurality of blades;

a frame for receiving the blades therein, wherein a height of the frame is reduced to an extent for exposing the blades, and the frame includes a plurality of air-guiding parts directly extended from corner areas of the frame; and a cover assembled with the frame through the air-guiding parts, and having a top portion and at least one side plate, wherein the side plate is extended from peripheral edge of the top portion and vertically bent downwards, the side plate is formed with a plurality of bars and openings, and the side plate abuts against the air guiding part of the frame.

12. The cooling fan of claim 11, wherein the adjacent openings of the side plate are spaced by one of the bars.

13. The cooling fan of claim 11, wherein the bars of the side plate are vertical bars, and the vertical bars are biased by a predetermined angle with respect to the side plate.

14. The cooling fan of claim 11, wherein the bars of the side plate are lateral bars, and the lateral bars are horizontally biased by a predetermined angle with respect to the side plate.

15. The cooling fan of claim 11, wherein the top portion of the cover is formed with a plurality of bars and openings in a manner that adjacent openings are spaced by one of the bars.

16. The cooling fan of claim 15, wherein top surfaces of the bars of the top portion are biased by a predetermined angle with respect to the top portion of the cover.

17. The cooling fan of claim 11, wherein the bars and the openings of the side plate are substantially vertically or horizontally arranged.

18. The cooling fan of claim 11, wherein the top portion is formed with a frame shape.

19. The cooling fan of claim 11, wherein the frame further includes a plurality of ribs formed on a bottom portion of the frame for supporting the blades and strengthening the cooling fan.

* * * * *